United States Patent [19]

O'Neill

[11] Patent Number: 5,066,016

[45] Date of Patent: Nov. 19, 1991

[54] METHOD OF PLAYING A BOX-OFFICE MOVIE GAME

[76] Inventor: Mark D. O'Neill, 11 Monmouth Rd., Oceanport, N.J. 07757

[21] Appl. No.: 622,974

[22] Filed: Dec. 6, 1990

Related U.S. Application Data

[63] Continuation of Ser. No. 462,146, Jan. 8, 1990, abandoned.

[51] Int. Cl.[5] ..... A63F 3/00

[52] U.S. Cl. ..... 273/249; 273/440; 273/290; 273/431

[58] Field of Search ..... 273/249, 243, 269, 256, 273/440, 290, 429–432

[56] References Cited

U.S. PATENT DOCUMENTS 4,932,667 6/1990 Gorski et al. ..... 273/249

OTHER PUBLICATIONS

"Trivial Pursuit", Master Game-Rules of Play, Selchow & Righter Co., 1981.

"The Trivia Game Trivia Game", Games Magazine, Dec. 1984, pp. 24–25.

*Primary Examiner*—Benjamin Layno

*Attorney, Agent, or Firm*—Charles I. Brodsky

[57] ABSTRACT

This invention describes a board game where individual players are questioned in an attempt to correctly identify a movie from which a quotation comes, in accordance with the position on the Board where the player lands. The player is additionally required to impersonate actors and/or actresses for the other players to identify, in accordance with landings on other positions on the Board. The object of the game is to traverse the Board while attaining a plurality of achievement awards showing competency in such movie disciplines as "Comedy", "Action & Adventure", "Drama & Musicals", "Mystery & Horror" and "Science Fiction & Fantasy", and to then ascend a "winner's podium".

6 Claims, 2 Drawing Sheets

METHOD OF PLAYING A BOX-OFFICE MOVIE GAME

This application is a continuation of application Ser. No. 07/462,146, filed Jan. 8, 1990 now abandoned.

FIELD OF THE INVENTION

This invention relates to "board games", in general, and to such a game for adult afficionados of "movie" trivia, in particular.

BACKGROUND OF THE INVENTION

As is well known and understood, one of the most popular form of indoor entertainment is the playing of board games. As is also well known and understood, there exist many different types of board games for adults, for children, and for playing by adults and children simultaneously. In recent years, moreover, board games have been produced which call upon interaction with the individual players, calling upon them to do more than just move their playing piece around a Board in a predetermined manner, but to participate by answering questions posed by other players at the same time. The most popular currently of such games today are those emanating from the introduction of "Trivial Pursuit" some few years back, where players are questioned concerning facts of general knowledge. Other popular games at present are of the "Pictionary" series, which require action by the players in an attempt to convey information to his, or her, partner(s). In other words, and as will be apparent, the "Pictionary" type game may be considered to be more "active" in nature, while the "Trivial Pursuit"-type game is more "passive" in nature.

SUMMARY OF THE INVENTION

As will become clear hereinafter, the "Box-Office" Movie Game of the invention combines both "active" and "passive" natures in affording an adult board game—and, particularly, one for "movie buffs", for indoor entertainment. As will be seen, the invention comprises a board game where individual players are questioned in an attempt to correctly identify a movie from which a quotation comes, in accordance with the position on the Board where the player lands. (In this respect, the game presents features common to previous board games of a generally "passive" nature.) The player is additionally required to impersonate actors and/or actresses for the other players to identify, in accordance with landings on other positions on the Board. (In this respect, the game takes on its "active" nature.) Landings on other positions dictate other actions to be taken—which, as will be noted, require neither "passive" knowledge of the player or "active" involvement, but merely dictate that certain things are to happen, without any "input" from the player landing there. As will be more fully described below, the object of the game is to traverse the board while attaining a plurality of achievement awards showing competency in such movie disciplines as "Comedy", "Action & Adventure", "Drama & Musicals", "Mystery & Horror" and "Science Fiction & Fantasy", and to then ascend "winner's podium". In a preferred embodiment of the invention to be described, the achievement awards are in the form of "nomination rings", one for each category of the movie disciplines utilized, to be placed upon a playing-piece statuette along the lines of a movie-land "Oscar".

BRIEF DESCRIPTION OF THE DRAWING

These and other features will be more clearly understood from a consideration of the following description, taken in connection with the accompanying drawing, in which.

DETAILED DESCRIPTION OF THE DRAWING

Figure 1:
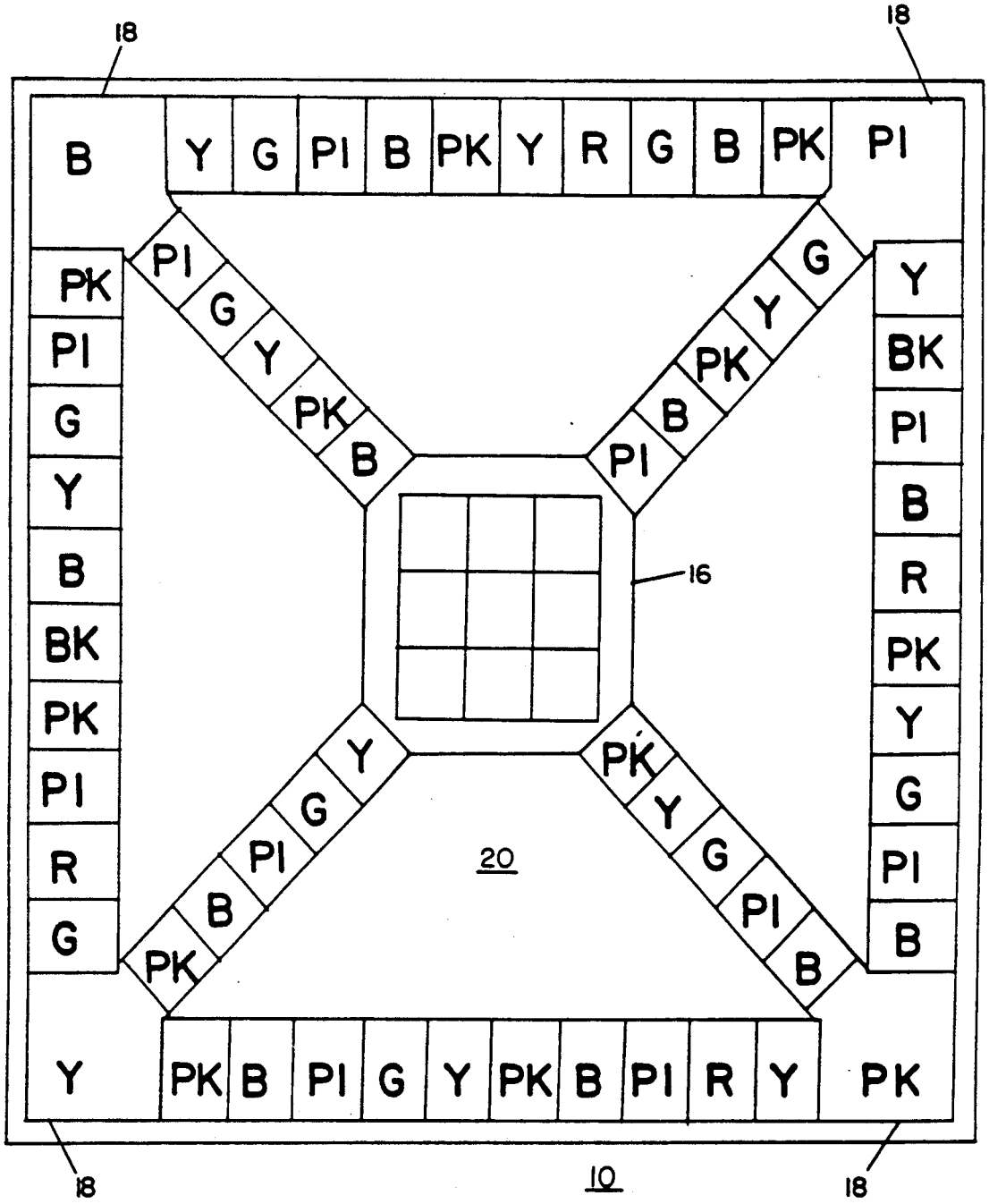
FIG. 1 illustrates one form of playing board as employed in a preferred embodiment of the present invention.
Figure 2:
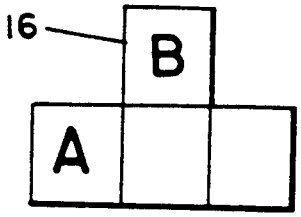
FIG. 2 is a side view of a "podium" which a winning player seeks to ascend in accordance with the rules of the game.
Figure 3:
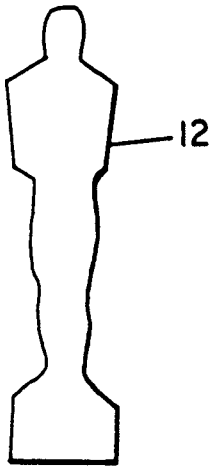
FIG. 3 pictorially shows a statuette-type of playing piece utilized by each player of the game.
Figure 4A:
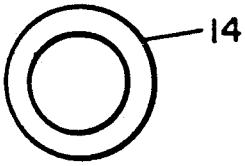
FIGS. 4*a* and 4*b* are top and side views, respectively, of the type of "nomination ring" which the player attains in accordance with the game rules, and which must be attained before the player can seek to ascend the "winner's podium" of FIG. 2.
Figure 4B:
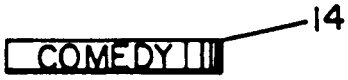

Referring to the drawing, it will first be understood that the "Box-Office" Movie Game of the invention includes one playing board 10, one conventional 6-sided die (not shown), a first plurality of Movie Quotation Cards, a second plurality of Actor/Actress Impersonation Cards, a third plurality of Set Back Cards, a plurality (e.g. 6) of player statuette trophies 12, a plurality (e.g. 30) of Achievement Award Nomination Rings 14, and a Winner's Podium 16. In one version of the game of the invention, some 100 Movie Quotation Cards were utilized, 60 Actor/Actress Impersonation Cards were used and 36 Set Back Cards were employed.

In preparation for the start of the game, the players divide into teams, with each team selecting one of the trophy statuettes 12, and 5 of the Achievement Award Nomination Rings, one for each category of the movie disciplines used. One player for each team is selected "Captain", who then rolls the die, and the "Captain" that rolls the highest number starts the game. Next in turn is the "Captain" that rolls the next highest number—and should two "Captains" tie, they roll again to come up with the order of starting. Of course, if there are insufficient numbers of players to form "teams", then each player may designate himself, or herself, as the "team" and to play individually.

As previously mentioned and as briefly described, the players, in turn, attempt to advance their trophy statuette 12 around the playing board 10, landing on different colored squares as they go, which represent various movie disciplines as "Comedy", "Action & Adventure", "Drama & Musicals", "Mystery & Horror" and "Science Fiction & Fantasy". Depending upon the color location, the players are read a quotation from a movie from one of the plurality of Movie Quotation Cards and if correctly identifying the movie from which the quotation comes, that player goes again. Should the player correctly identify a movie quotation that is marked on the Movie Quotation Card as a Nomination Ring quote (# next to the quote), the player collects an Achievement Award Nomination Ring 14 for that category. Play proceeds in a counterclockwise direction around the playing board 10 as many times as are necessary until a player collects five Nomination Rings—one for each of the five movie categories indicated—, and if that player also has completed at least one full lap around the Board 10, he or she can then proceed to the center of the playing board 10 for the final series of movie quotations as he, or she, ascends the winner's podium 16. The first player to correctly identify a movie quotation from atop the winner's podium 16 is declared the winner.

Referring now to FIG. 1, it will be seen that the playing board 10 is composed of a plurality of squares colored "Yellow" (Y), "Pink" (Pk), "Purple" (Pl), "Blue" (B) and "Green" (G), although in the actual construction of the Board 10 the squares are only "colored", without the need for any "lettering" to appear. Each such color square identifies one of the movie disciplines employed, as in the following manner: Yellow—comedy; Pink—action & adventure; Purple—drama & musicals; Blue—mystery & horror; and Green—science fiction & fantasy.

Also shown are a number (e.g. 4) squares that are colored "Red" (R), and a number (e.g. 2) of additional squares colored "black" (Bk). As for these positions on the Board 10, the "Red" square will be seen to require the player to impersonate an actor or actress from one of the plurality of Impersonator Cards utilized. If the player lands on the position colored "Black", the player follows the directions on the plurality of "Set Back Cards" used in playing the game. If the player were to land on a square colored "Yellow", "Pink", "Purple", "Blue" or "Green", then the player is asked to correctly identify that movie from which a quotation corresponding to the color of the square comes from.

Before describing a method of play according to a preferred embodiment of the invention, it would be helpful to understand how the "Movie Quotation Cards", the "Set Back Cards" and the "Impersonator Cards" may appear. Four examples of the "Movie Quotation Card" should be sufficient.

| Category | |
|---|---|
| | Quote |
| Yellow | 1. He slimed me! |
| Purple | 2. Now look here, Charlie Alnut. I can manage this boat as well as you can. |
| Pink | 3. I know its tough for you. They wouldn't let you in the Academy because you're Duke Mitchell's kid, you have to live with that reputation. It's like every time we go up there you're flying against a ghost. That makes me nervous. |
| Blue | 4. Yuri was sent here by the KGB while he was still in his teens and for all intents and purposes he can pass for an American. |
| Green | 5. He needs to go home. He's calling his people and I don't know where they are. |
| | Answers |
| | 1. Ghostbusters |
| | 2. The African Queen |
| | 3. Top Gun |
| | 4. No Way Out |
| | 5. E.T. |
| | Quote |
| Yellow | 1. This Cinderella story! Out of nowhere, a former greenskeeper now about to become a Masters champion. He hits the ball . . . oh, its in the hole! |
| Purple | 2. Wouldn't this be a great world if insecurity and desperation made us more attractive. |
| Pink | 3. Where the hell did you get him, Pyscho's-R-Us? |
| Blue | 4. Murder can be an art, too. The power to kill can be just as satisfying as the power to create. |
| Green | 5. Mom. There's something out there. Its in the tool shed. It threw the ball at me. |
| | Answers |
| | 1. Caddyshack |
| | 2. Broadcast News |
| | 3. Lethal Weapon |

-continued

| Category | |
|---|---|
| | 4. Rope |
| | 5. E.T. |
| | Quote |
| Yellow | 1. I'll prove myself to you. I'll solve your little problem and then you'll say "Pete Vinckman is a guy who can get things done. I wonder what makes him tick." |
| Purple | 2. The train had knocked Ray Brower out of his Keds, just like it had knocked the life out of his body. |
| Pink | 3. Son, your ego is writing checks your body can't cash. |
| Blue | 4. One medium-dry vodka martini. Mixed like you said, sir. Not stirred. |
| Green | 5. Never tell me the odds! |
| | Answers |
| | 1. Ghostbusters |
| | 2. Stand By Me |
| | 3. Top Gun |
| | 4. Dr. No. |
| | 5. Star Wars |
| | Quote |
| Yellow | 1. Hooray for Captain Spalding, the African explorer. |
| Purple | 2. Rosebud. |
| Pink | 3. Come on, make my day. |
| Blue | 4. The stuff that dreams are made of. |
| Green | 5. I never drink . . . wine. |
| | Answers |
| | 1. Animal Crackers |
| | 2. Citizen Kane |
| | 3. Dirty Harry |
| | 4. The Maltese Falcon |
| | 5. Dracula |

As will be seen, these quotations call for the "passive" involvement of the player, by identifying the movie from which the quotation comes.

The next, Set Back Square Cards, on the other hand, require no involvement by the player—either of a "passive" nature or of an "active" nature, and direct the player in what to do. Again, four examples of these Set Back Square Cards should illustrate their various contents.

| | |
|---|---|
| 1. Setback | Your latest comedy film is trashed by the critics. |
| Penalty | Since your film is receiving good word-of-mouth advertising and is setting BOX OFFICE records, retreat 7 squares and roll again. |
| 2. Setback | Your latest epic western is way over budget. |
| Penalty | Since no one at the studio knows this yet, your penalty is to retreat 4 squares and roll again. |
| 3. Setback | Your latest musical film is panned by the critics. |
| Penalty | Since even your spouse and children hate the film, your penalty is to retreat 9 squares and roll again. |
| 4. Setback | Your latest comedy film about two vaudevillians in the desert is rumored to be way over budget. |
| Penalty | Since your BIG EGO is still giving you delusions of grandeur and riches (even though you are $30 million over budget), forfeit one Nomination Ring, retreat 7 squares and roll again. If you don't have a Nomination Ring, retreat 10 squares and forfeit this turn. |

The Impersonation Cards of the invention identify one actress and two actors, for example, along with a list of movies that they have appeared in. Upon selecting one of these cards, the player picks either the actress or one of the two actors, and, through impersonation, or otherwise, tries to convey to the other players who that person might be. As will be seen, this requires the "active" participation of the player. Again, four card layouts would be helpful in explaining the configuration.

| Impersonation Cards |
|---|
| 1. Karen Allen |
| Raiders of the Lost Ark |
| Animal House |
| Star Man |
| William Defoe |
| Platoon |
| To Live and Die in L.A. |
| The Last Temptation of Christ |
| William Shatner |
| Star Trek |
| The Babysitter |
| Visiting Hours |
| 2. Ingrid Bergman |
| Casablanca |
| Cactus Flower |
| Gaslight |
| Cary Grant |
| Arsenic and Old Lace |
| To Catch a Thief |
| North by Northwest |
| Dan Aykroyd |
| Ghostbusters |
| 1941 |
| Spies Like Us |
| 3. Bo Derek |
| 10 |
| Bolero |
| Tarzan |
| Marty Feldman |
| Young Frankenstein |
| Silent Movie |
| Lawrence Olivier |
| David Copperfield |
| Pride and Prejudice |
| Rebecca |
| 4. Mia Farrow |
| Rosemary's Baby |
| The Purple Rose of Cairo |
| Zelig |
| Billy Dee Williams |
| Return of the Jedi |
| Mahogany |
| Lady Sings the Blues |
| Sylvester Stallone |
| Rocky |
| Rambo II |
| Over the Top |

As previously indicated, in a preferred embodiment of the invention there may be utilized 100 Movie Quotation Cards, 36 Set Back Cards, and 60 Impersonation Cards. Before the game begins, each set of these cards is shuffled and placed in a rack, for example, until needed.

The general rules of the game, and its play, may be as follows. All players—whether they be captain of a team or an individual—begin their play with their trophy statuettes 12, on one of the corner squares 18. The player with the first turn then throws his, or her, die, and moves the trophy statuette 12 the number of squares shown on the die. Another player then selects the first card from the Movie Quotation Card Rack and reads the quotation that corresponds in color and category to the square landed on by the first player. The quotations, in particular, are read from the front of the card and replaced into the rear of the Movie Quotation Card rack after the player's response is given. The correct identification of the quotation is listed on the back of each card. If the player correctly identifies the quotation, indicating the movie from which the quotation came, then that player throws the die again and continues around the Board 10 in a counterclockwise direction; if the answer is incorrect, on the other hand, then the die passes from that player to the next one to go.

In play, the players proceed in a counterclockwise direction around the Board 10, and must make at least one complete lap (i.e. passing the start square 18) and collect the five Achievement Award Nomination Rings (one from each movie category) before progressing into the center of the playing board 20, where the winner's podium 16 is. One way a player collects an Achievement Award Nomination Ring is in answering a quotation on a Movie Quotation Card identified by a characterizing symbol, e.g. a #. Thus, for instance, if the player starts from the cover square 18' and throws a "2", if the Movie Quotation Card contains the symbol # alongside the category "G" for "Science Fiction & Fantasy" then the player will attain the Achievement Award Nominating Ring for that category if he correctly identifies the movie from which the "Science Fiction & Fantasy" quotation came from; otherwise, the player will not attain that Nominating Ring.

In continuing the game, the players are not required to land on a corner square in order to enter the center 20 of the playing board 10, once they have attained the 5 Achievement Award Nomination Rings 14. For example, if a player throws a "6" at a time when he, or she, is only "two" squares away from a corner square, the player then moves the two squares onto the corner, and then proceeds four squares into the center 20. During play, the players always move the number of squares designated by the throw of the die, except when approaching the winner's podium 16 at the center of the board, where all rolls end on the first step of the podium.

Should a player, on the other hand, land on one of the "black" Set Back Squares, at that time another player chooses the first card from the Set Back square rack and reads to the player the set back penalty imposed. As with the Movie Quotation Card, the Set Back Card is then replaced at the rear of the Set Back Square Rack.

In the event that the player lands on the "red" Impersonation Square, then that player chooses the first card from the Impersonation Square Rack. As noted, each card contains the names of two actors and one actress along with a list of movies in which they have appeared. The player so landing is then allowed two impersonations of one of the actors or of the actress listed, and should the impersonation be correctly guessed by another player—either from his own team where team play follows, or from another player in individual play—, the impersonating player throws the die again and continues until forfeiting the die in the normal course of play, i.e. by answering a later quote incorrectly (or, by the dictates of a Set Back Square Card). At the same time, the player who correctly guesses the impersonation—or the impersonating player's team if one of its members correctly guesses the impersonation—collects a Nomination Ring of his or their choice, without having to identify any movie quotation. Should the impersonation not be guessed correctly, however, the player doing the impersonation remains on that Impersonation Square until the next turn, where they select a new Impersonation Card, and try once more. Should the second impersonation also not be guessed correctly, that player waits until the next turn, where, upon throwing the die, finally moves from that Impersonation Square further around the Board.

After the player has collected the five Achievement Award Nomination Rings 14 and made at least one complete lap around the playing board (more laps, if needed, until the five Nomination Rings have been attained), the player can then enter the center of the board 20, to progress towards the winner's podium 16. As previously mentioned, all throws of the die end at the first level of the podium such that, for example, if a player is two squares away from the podium 16 and throws a 6, that player only moves to the first level of the podium 16 and stops. All players, therefore, begin on the first level of the podium 16, and begin to climb the podium one level at a time. Upon reaching the podium, to move towards the top, the player must correctly identify a movie quotation. If the player answers incorrectly, they remain on that level until their next turn comes. On the first level A of the podium 16, the player then there selects the category that the other players must selected the quote from. On the second level B of the podium 16, the other players, by agreement or by majority vote, select the category of the five available movie quotations that the player must identify. The first player to identify the movie quotation from the second level B is declared the winner.

In playing the game, the players, by agreement, majority vote, or otherwise, decide as to how long a player may take to identify the movie quotation and just how precise that identification must be. In similar manner, time limits are established for guessing impersonations on those occasions where the player lands on the "red" Impersonation Squares. In similar fashion, players may divide the categories amongst themselves at the beginning of the game for reading purposes, according to which one player may read all the quotations from the "Comedy" category, another from the "Drama" category, etc. Also, that player reading may supervise the dispensing of the Achievement Award Nomination Rings 14 for that category at the beginning, and hand them out when a quotation from the category is correctly identified. However, should that player land on a square from the category he, or she, is supervising, then the quotation is read by another player.

For impersonations, the game rules may be decided upon by the players to utilize both verbal and non-verbal clues, inclusive of the imitations of facial expressions, walks, mannerisms, as well as other quotes from the movies, in order to add to the communication of identifying information and to increase the fun of playing the "Box-Office" Movie Game. Along this line, it might be more fun-filling if the players decide beforehand that the male players who land on Impersonation Squares only do impersonations of the actresses identified on the Impersonation Cards, and that the female players only do impersonations of the actors there set forth. These and other rules may be agreed upon beforehand to increase the flexibility of play.

While there has been described what is considered to be a preferred embodiment of the present invention, it will be readily apparent that modifications can be made by those skilled in the art without departing from the scope of the teachings herein. Thus, whereas the invention has been described in its particular environment of a "movie-type" game, it will be equally clear that the format can be utilized in a similar manner for identifying theatrical plays, television programs, books, songs, etc. All that would be required, would be a similar series of play where players are called upon to correctly identify a quotation identifying that source work, and impersonating individuals associated with such art forms. As will be seen, even in those environments, the playing of the game will be seen to combine the "passive" knowledge of the player with his, or her, "active" participation in impersonating—by words, expressions or manners—the individual identified. For at least such reasons, therefore, resort should be had to the claims appended hereto for a true understanding of the scope of the invention.

I claim:

1. A method of playing a box-office movie identification game comprising the steps of:

providing a playing board;

providing a plurality of playing pieces;

providing means directing movement of said pieces to predetermined positions around said board in accordance with player actuations thereof;

providing a set of quotation cards for player identification of specific, box-office movie films;

providing a set of acting cards for player impersonation of performers in specific, box-office movie film roles;

providing on said board a first plurality of spaces that call for the reading to a player of a quotation from a specific theater-released feature film, and a second plurality of spaces that call for the impersonation by the player of a performer in a specific theater-released feature film role;

wherein each quotation card contains a quotation spoken in a theater-released feature film of a category of "Comedy", "Action & Adventure", "Drama & Musicals", "Mystery & Horror", and "Science Fiction & Fantasy", which are to be read to the player for the player to identify the film from which the quotations comes; and wherein each acting card contains the names of several actors and actresses and several of the theater-released feature films in which they each have performed players in turn moving their playing pieces along the board according to said movement directing means;

a player drawing an acting card when his playing piece lands on one of said second plurality of spaces;

said player selecting one of the named actors and actresses on said acting card and selecting one of the listed films on said acting card which the selected actor or actress performed in;

said player determining which actor or actress and which film to select by determining which actor or actress and the film the player is most familiar with and most skilled at impersonating;

said player performing an impersonation of the selected actor's or actresse's role in the selected film for the other players to identify.

2. The method of playing a box-office movie identification game of claim 1 also providing a set of set-back cards for impeding movement of playing pieces around said board in accordance with the introduction of hypothetical problems that may arise in movie film production.

3. The method of playing a box-office movie identification game of claim 2 providing on said board a third plurality of spaces that call for the selection of a set-back card in the directing of movement of playing pieces around said board.

4. The method of playing a box-office movie identification game of claim 3 wherein said playing pieces are in the form of OSCAR-type statuettes specifically marking a players position on said board during the course of a game's play.

5. The method of playing a box-office movie identification game of claim 4 providing a plurality of adornments for said statuettes corresponding to each of said theater-released feature film categories of "Comedy", "Action & Adventure", "Drama & Musicals", "Mystery & Horror", and "Science Fiction & Fantasy";

wherein said adornments are obtained by a player correctly identifying the actor or actress so impersonated in a theater-released feature film role by such other player; and wherein the collection of all of said plurality of adornments is a pre-requisite for continuing with playing of said game for an added objective of winning said game.

6. The method of playing a box-office movie identification game of claim 5 wherein said adornments are also obtained by a player correctly identifying a theater-released feature film in which a predetermined quotation, read to the player, is spoken.

* * * * *